US007007796B2

(12) United States Patent
Lin

(10) Patent No.: US 7,007,796 B2
(45) Date of Patent: Mar. 7, 2006

(54) OPENING DEVICE FOR COSMETIC COMPACTS

(75) Inventor: Pei-Lain Lin, Tainan Hsieh (TW)

(73) Assignee: Mei-Shual Cosmetics Co., Ltd., Tainan (TW)

( * ) Notice: Subject to any disclaimer, the term of this patent is extended or adjusted under 35 U.S.C. 154(b) by 106 days.

(21) Appl. No.: 10/837,655

(22) Filed: May 4, 2004

(65) Prior Publication Data

US 2005/0247579 A1 Nov. 10, 2005

(51) Int. Cl.
*A45C 13/10* (2006.01)

(52) U.S. Cl. ..... 206/1.5; 206/581; 206/823; 292/37; 292/140; 292/159; 292/DIG. 11; 292/DIG. 37; 70/20; 70/52; 70/63; 132/293; 132/296

(58) Field of Classification Search ..... 206/1.5, 206/581, 823; 132/293, 294, 295, 296, 301, 132/316; 70/20, 50, 51, 52, 63, 162; 292/32, 292/37, 137, 140, 302, DIG. 11, DIG. 37; 220/218, 282, 283, 324, 833, DIG. 13
See application file for complete search history.

(56) References Cited

U.S. PATENT DOCUMENTS

| | | | | |
|---|---|---|---|---|
| 5,865,043 | A * | 2/1999 | Loughlin | 70/20 |
| 5,975,093 | A * | 11/1999 | Joulia | 132/293 |
| 6,283,129 | B1 * | 9/2001 | Yuhara et al. | 132/295 |
| 6,584,815 | B1 * | 7/2003 | Bremicker | 70/38 A |
| 2002/0162565 | A1 * | 11/2002 | Sebban | 132/293 |
| 2004/0089560 | A1 * | 5/2004 | Sueda | 206/38.1 |
| 2005/0178695 | A1 * | 8/2005 | Petit | 206/581 |
| 2005/0210932 | A1 * | 9/2005 | Azzalin et al. | 70/51 |

* cited by examiner

*Primary Examiner*—David T. Fidei
(74) *Attorney, Agent, or Firm*—Rosenberg, Klein & Lee

(57) ABSTRACT

A cosmetic compact includes a base and a cover is pivotably connected to a lower end of the base. The base has a ridge located on a top thereof and a recess is defined in the top of the base and located in opposite to the ridge. A U-shaped shackle-like member has a first end pivotably connected to the ridge and a pushing end is defined in a second end of the U-shaped shackle-like member. The cover has a block extending from a top of the cover and the pushing end pushes the block to pivot the cover away from the base when lowering the second end of the shackle-like member.

5 Claims, 6 Drawing Sheets

OPENING DEVICE FOR COSMETIC COMPACTS

FIELD OF THE INVENTION

The present invention relates to a cosmetic compact that has a U-shaped shackle-like member which is pushed downward to pivot the cover relative to the base to open the cosmetic compact.

BACKGROUND OF THE INVENTION

A conventional cosmetic compact such as a makeup powder compact or a blush compact is disclosed in FIG. 7 and generally includes a base 40 with a plurality of chambers 42 for receiving different colors of the powders, and a cover 50 with a mirror 51 on an underside thereof is pivotably connected to a side of the base 40. A protrusion 52 extends from the underside of a side of the cover 50 so as to be cooperated with an engaging portion 42 to secure the cover 50 relative to the base 40. The outer appearance of the conventional cosmetic compact is almost the same and cannot attract the younger users who want to have a cosmetic compact that has different shape from the conventional ones.

The present invention intends to provide a cosmetic compact that includes a U-shaped shackle-like member which has one end pivotably connected to the base and the other end of the U-shaped shackle-like member includes an inclined surface so as to push the cover to open the compact easily.

SUMMARY OF THE INVENTION

The present invention relates to a cosmetic compact which comprises a base and a cover which is pivotably connected to a lower end thereof. The base has a receiving space defined in an inside thereof and a ridge is located on a top of the base. Two protrusions extend from two opposite sides of the ridge and a recess is defined in the top of the base and located in opposite to the ridge. The cover has a block extending from a top of the cover. A U-shaped shackle-like member has a first end with a slot with which the ridge is received. A pushing end is defined in a second end of the U-shaped shackle-like member and pushes the block to pivot the cover away from the base when lowering the second end of the shackle-like member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
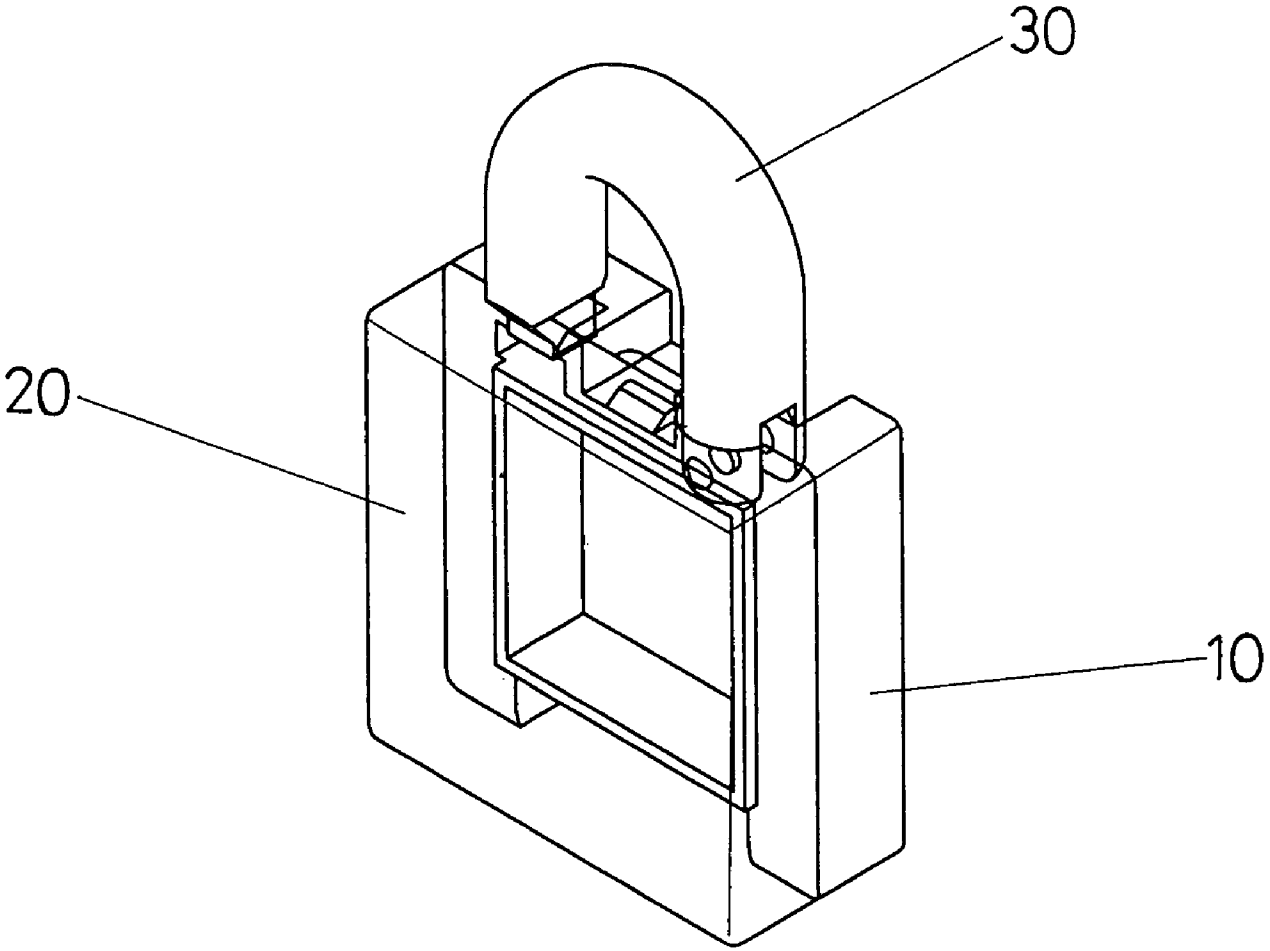
FIG. 1 is a perspective view to show the cosmetic compact of the present invention.
Figure 2:
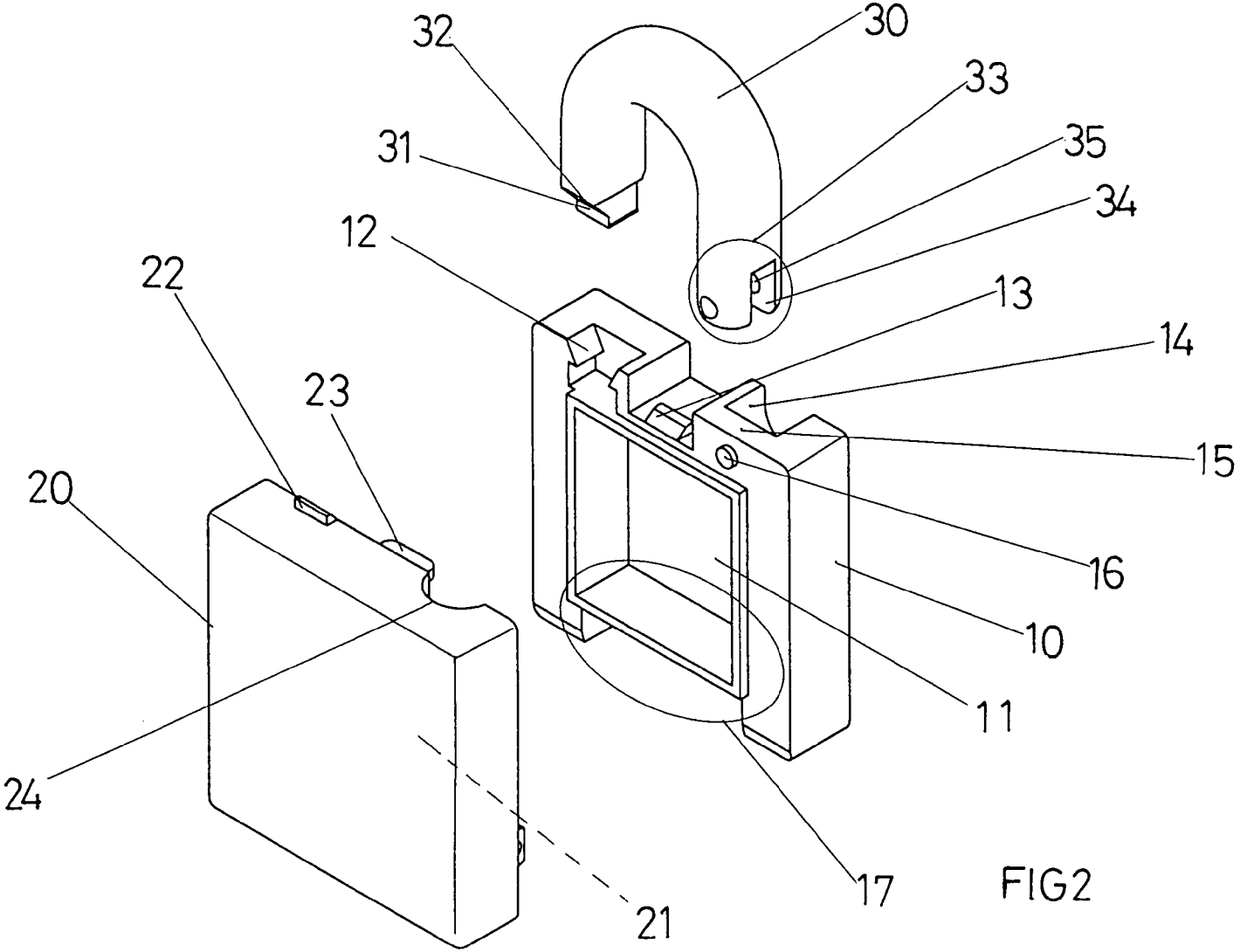
FIG. 2 is an exploded view to show the cosmetic compact of the present invention.
Figure 3:
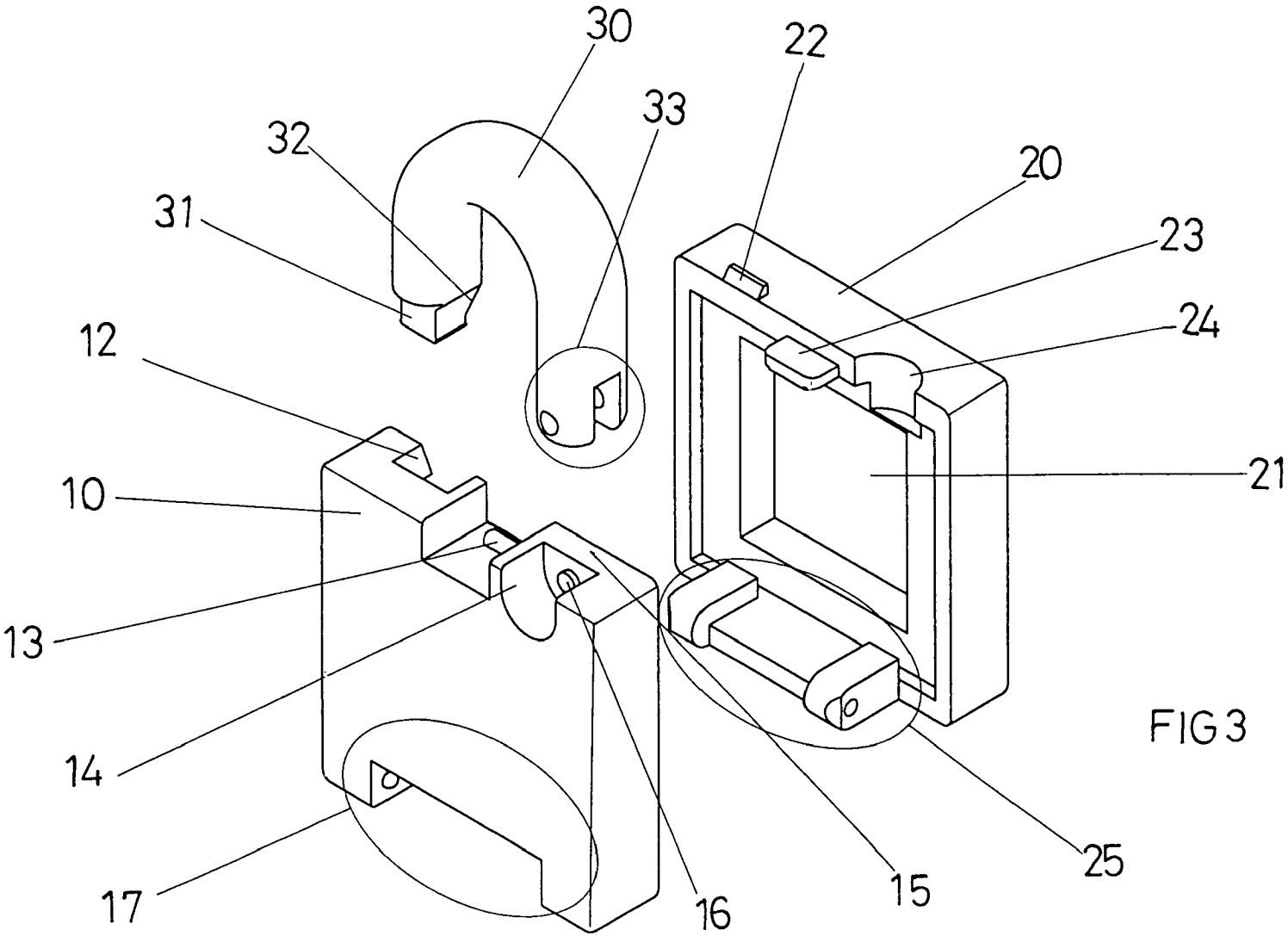
FIG. 3 shows an exploded view viewed from the other side of the cosmetic compact of the present invention.

Referring to FIGS. 1 to 3, the cosmetic compact of the present invention comprises a base 10 having a receiving space 11 defined in an inside thereof so as to receive cosmetic products therein and a first semi-circular notch 14 is defined in a side of a top of the base 10 so as to form a ridge 15. Two protrusions 16 extend from two opposite sides of the ridge 15. A recess 12 is defined in the top of the base 10 and located in opposite to the ridge 15. An engaging piece 13 extends from the top of the base 10 and located between the first semi-circular notch 14 and the recess 12. The base 10 includes a concavity 17 defined in the lower end thereof such that a cover 20 is pivotably connected to a lower end of the base 10 by pivotably engaging an insertion 25 extending from a lower end of the cover 20 with the concavity 17. A block 22 including a first inclined surface extends from a top of the cover 20 and is located in correspondence with the recess 12 of the base 10. The cover 20 has a second semi-circular notch 24 defined in a top thereof and located corresponding to the ridge 15. The cover 20 has a locking plate 23 which is engaged with the engaging piece 13 when the cover 20 is in a close position relative to the base 10.

Figure 5:
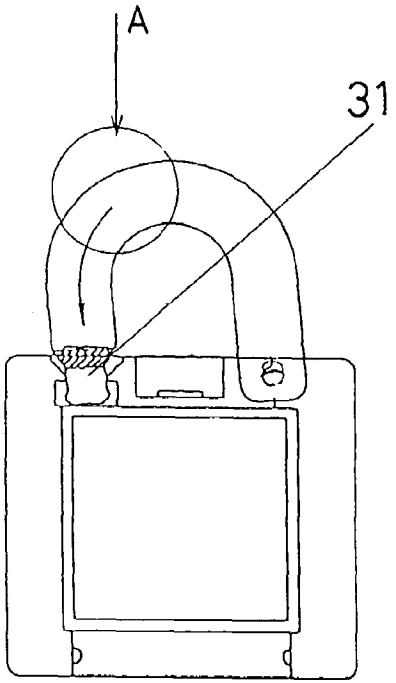
FIG. 5 shows front and side views of the cosmetic compact of the present invention wherein the cover is in its open position.
Figure 4:
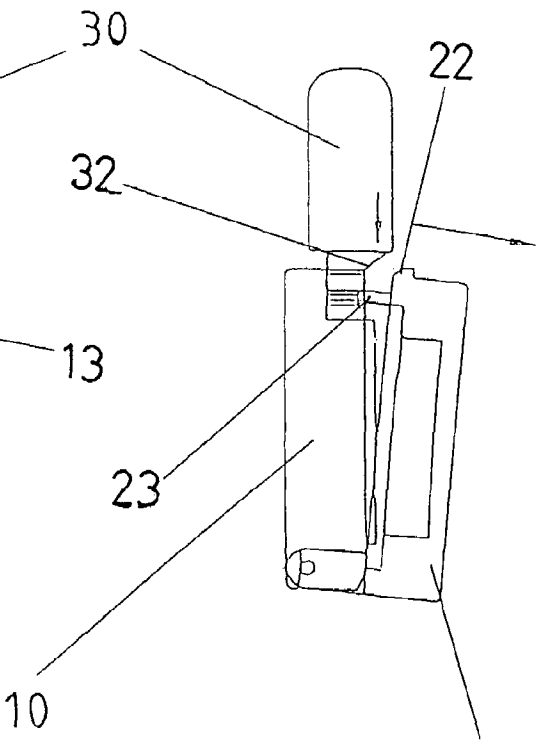
FIG. 4 shows front and side views of the cosmetic compact of the present invention wherein the cover is in its close position.
Figure 4:
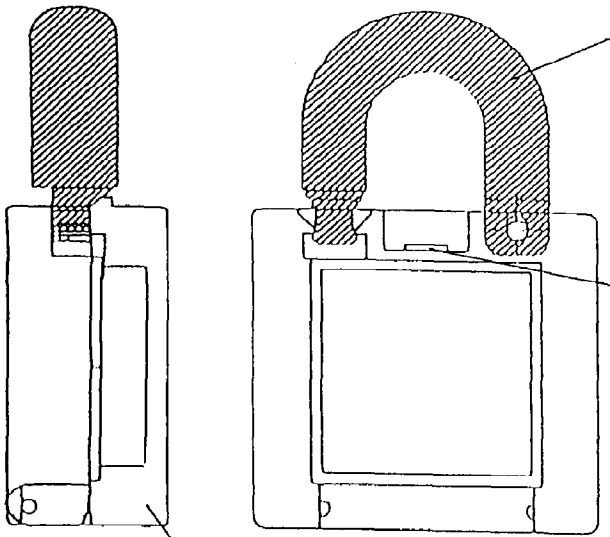

Further referring to FIGS. 4 and 5, a U-shaped shackle-like member 30 has a first end with a slot 34 defined therein and the ridge 15 is received in the slot 34. The first end of the U-shaped shackle-like member 20 is rested in the first and second semi-circular notches 14, 24. Two holes 35 are defined in two parts separated by the slot 34 of the first end of the U-shaped shackle-like member 30 and the two protrusions 16 are pivotably engaged with the two holes 35 in the first end of the U-shaped shackle-like member 30. A pushing end 31 is defined in a second end of the U-shaped shackle-like member 30 and has a second inclined surface 32 which pushes the first inclined surface on the block 22 to pivot the cover 20 away from the base 10 when lowering the second end of the shackle-like member 30.

Figure 6:
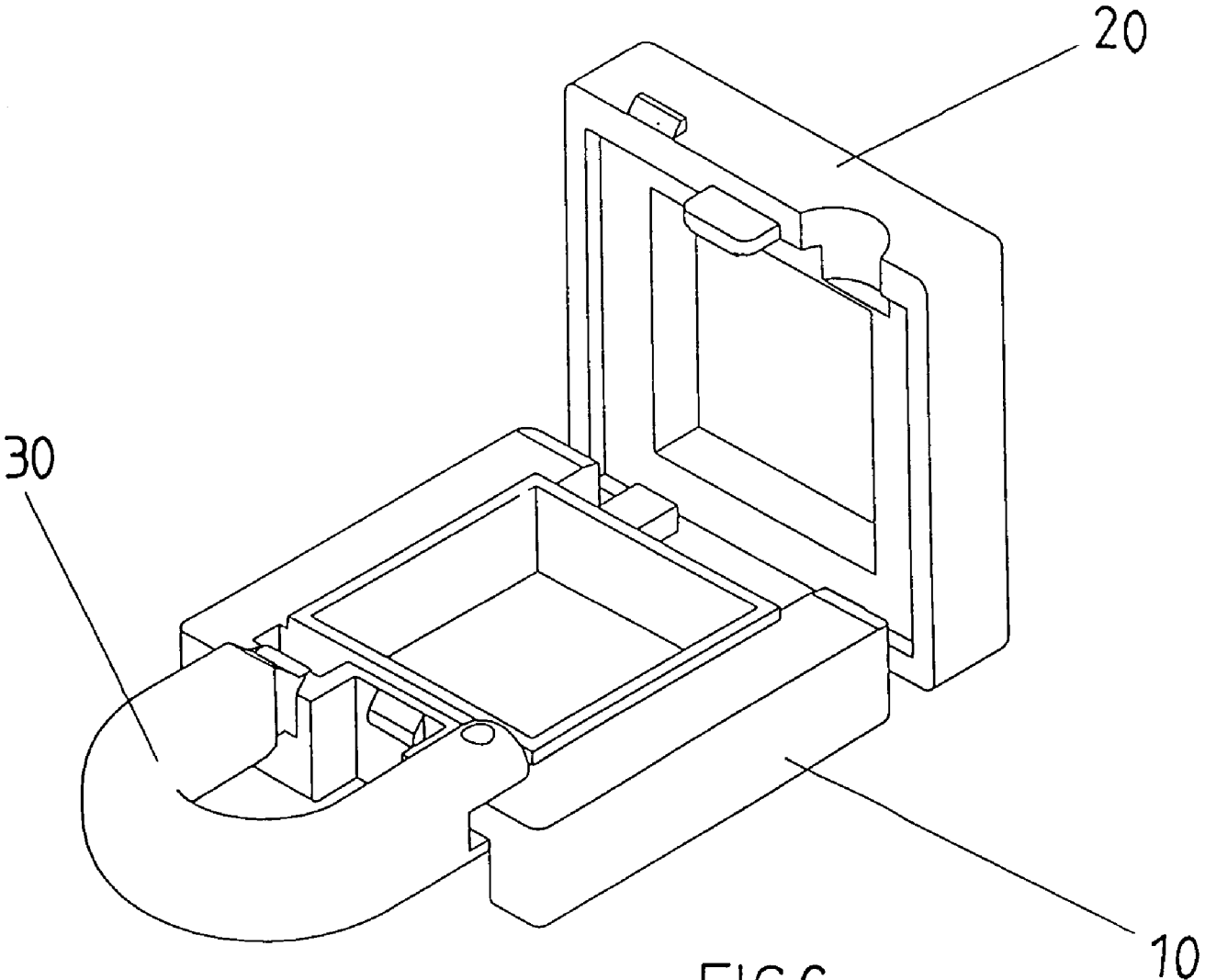
FIG. 6 is a perspective view to show that the cosmetic compact of the present invention wherein the cover is in its open position.
Figure 7:
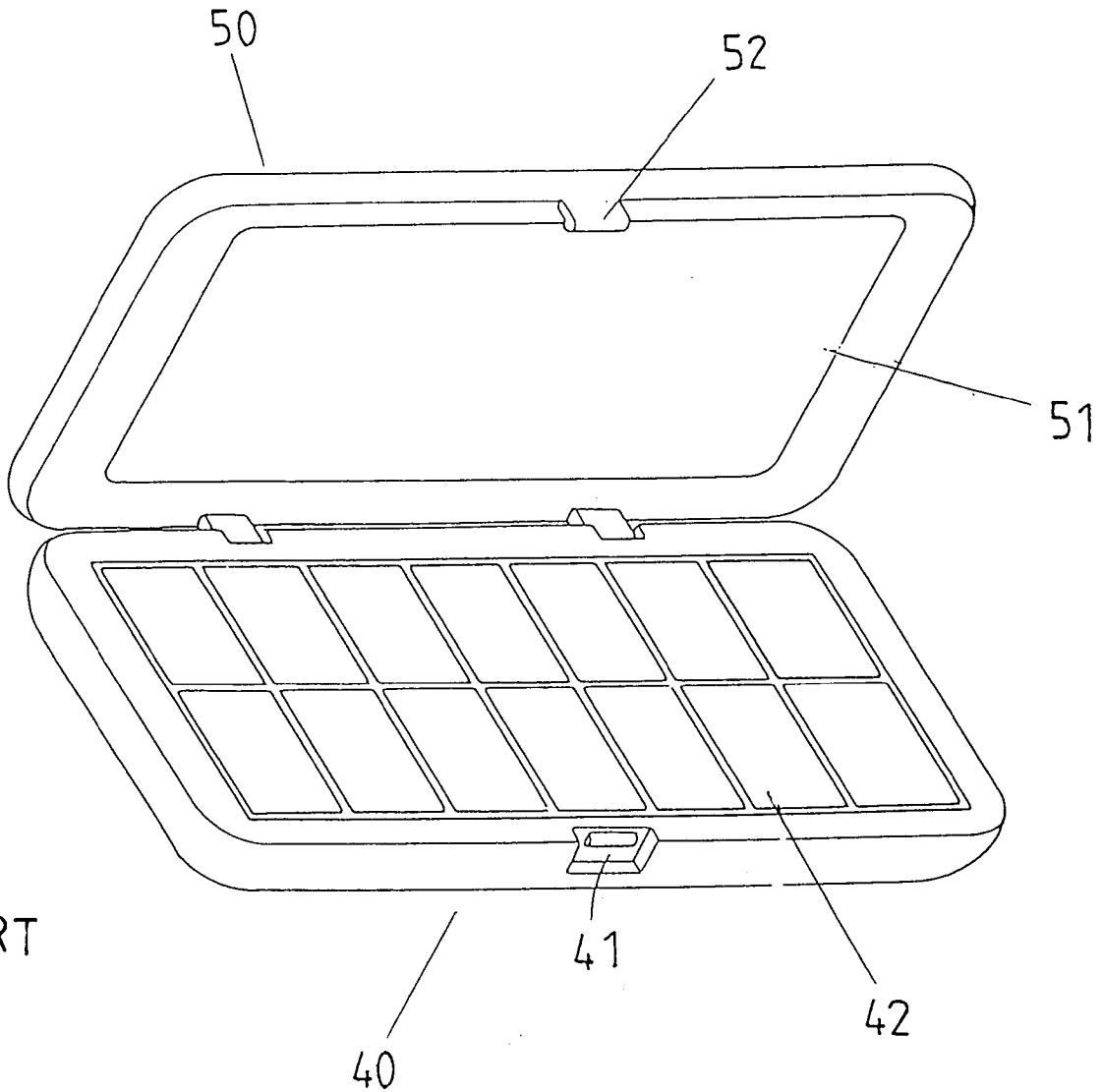
FIG 7 PRIOR ART
FIG. 7 shows a conventional cosmetic compact.

As shown in FIG. 6, a mirror is installed to a recess 21 defined in an inside of the cover 20. The cosmetic compact of the present invention is easily to open and has a U-shaped shackle-like member 30 which makes the cosmetic compact to be attractive and different from the conventional cosmetic compacts.

While we have shown and described the embodiment in accordance with the present invention, it should be clear to those skilled in the art that further embodiments may be made without departing from the scope of the present invention.

What is claimed is:

1. A cosmetic compact comprising:

a base having a receiving space defined in an inside thereof and a ridge located on a top of the base, a recess defined in the top of the base and located in opposite to the ridge;

a cover pivotably connected to a lower end of the base and a block extending from a top of the cover, and a U-shaped shackle-like member having a first end with a slot defined therein and the ridge received in the slot, a pushing end defined in a second end of the U-shaped shackle-like member and pushing the block to pivot the cover away from the base.

2. The cosmetic compact as claimed in claim 1, wherein the pushing end includes a first inclined surface and the block includes a second inclined surface so that when lowering the pushing end, the first inclined surface pushes the second inclined surface.

3. The cosmetic compact as claimed in claim 1, wherein the base includes a concavity defined in the lower end thereof and an insertion extends from a lower end of the cover and is pivotably engaged with the concavity.

4. The cosmetic compact as claimed in claim 1, wherein the base has an engaging piece extending from the top thereof and the cover has a locking plate which is engaged with the engaging piece when the cover is in a close position relative to the base.

5. The cosmetic compact as claimed in claim 1, wherein two protrusions extend from two opposite sides of the ridge and two holes are defined in two parts separated by the slot of the first end of the U-shaped shackle-like member, the two protrusions pivotably engaged with the two holes in the first end of the U-shaped shackle-like member.

* * * * *